US010584700B1

(12) United States Patent
Yabuuchi et al.

(10) Patent No.: US 10,584,700 B1
(45) Date of Patent: Mar. 10, 2020

(54) HIGH-PRESSURE FUEL PUMP

(71) Applicant: TOYOTA JIDOSHA KABUSHIKI KAISHA, Toyota-shi (JP)

(72) Inventors: Takeyuki Yabuuchi, Toyota (JP); Hirokazu Yokoyama, Toyota (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 216 days.

(21) Appl. No.: 14/901,127

(22) PCT Filed: Jun. 5, 2014

(86) PCT No.: PCT/IB2014/000975
§ 371 (c)(1),
(2) Date: Dec. 28, 2015

(87) PCT Pub. No.: WO2014/207520
PCT Pub. Date: Dec. 31, 2014

(30) Foreign Application Priority Data

Jun. 27, 2013 (JP) ..... 2013-134963

(51) Int. Cl.
*F04B 53/16* (2006.01)
*F04B 1/04* (2020.01)
(Continued)

(52) U.S. Cl.
CPC ..... *F04B 53/16* (2013.01); *F04B 19/22* (2013.01); *F04B 53/10* (2013.01); *F04B 53/14* (2013.01)

(58) Field of Classification Search
CPC ..... F04B 53/16; F04B 19/22; F04B 53/10; F04B 53/14
(Continued)

(56) References Cited

U.S. PATENT DOCUMENTS 8,167,577 B2 5/2012 Hokkanen
2004/0055580 A1 3/2004 Yamada et al.
(Continued)

FOREIGN PATENT DOCUMENTS

JP 2006 194218 7/2006
JP 2006 257972 9/2006
(Continued)

OTHER PUBLICATIONS

English Translation of JP 2010-190105 A (Yusuke) obtained on Oct. 24, 2017.*
(Continued)

*Primary Examiner* — Dominick L Plakkoottam
*Assistant Examiner* — Connor J Tremarche
(74) *Attorney, Agent, or Firm* — Oblon, McClelland, Maier & Neustadt, L.L.P.

(57) ABSTRACT

A high-pressure fuel pump (10) includes a plunger (11), a pump housing (12), an intake valve (13), a discharge passage (14), a fuel seal member (18), and a fuel inlet conduit (34). The pump housing (12) includes a fuel pressurizing chamber (23), an intake passage (24*a*), a discharge passage (24*b*), a cylinder housing member (21), a cover member (31) that covers the cylinder housing member (21), and an intake gallery chamber (12*g*). The fuel inlet conduit (34) is connected to the cover member (31) and configured to introduce fuel into the intake gallery chamber (12*g*) from outside the cover member (31). The pump housing (12) includes a return passage (33*e*) that communicates the intake gallery chamber (12*g*) with a space surrounded by the plunger (11), the cylinder housing member (21), and the fuel seal member (18). A first end portion of the return passage (33*e*) on the intake gallery chamber (12*g*) side is positioned on an opposite side of the cylinder housing member (21) from the fuel inlet conduit (34).

7 Claims, 5 Drawing Sheets

(51) Int. Cl.

| | |
|---|---|
| ***F02M 59/44*** | (2006.01) |
| ***F02M 59/02*** | (2006.01) |
| ***F04B 19/22*** | (2006.01) |
| ***F04B 53/10*** | (2006.01) |
| ***F04B 53/14*** | (2006.01) |

(58) Field of Classification Search
USPC ..... 417/568
See application file for complete search history.

(56) References Cited

U.S. PATENT DOCUMENTS

| | | | | |
|---|---|---|---|---|
| 2008/0019853 | A1* | 1/2008 | Hashida | F02M 59/102 417/490 |
| 2008/0056914 | A1* | 3/2008 | Usui | F02M 55/04 417/307 |
| 2012/0195780 | A1* | 8/2012 | Matsumoto | F04B 1/0404 417/559 |

FOREIGN PATENT DOCUMENTS

| | | | | |
|---|---|---|---|---|
| JP | 2009-293597 | A | | 12/2009 |
| JP | 2010-190105 | A | | 9/2010 |
| JP | 2010190105 | A | * | 9/2010 |
| JP | 2012-211558 | A | | 11/2012 |
| JP | 2013 60945 | | | 4/2013 |
| WO | 00 47888 | | | 8/2000 |

OTHER PUBLICATIONS

International Search Report dated Nov. 11, 2014 in PCT/IB2014/000975 filed Jun. 5, 2014.

* cited by examiner

HIGH-PRESSURE FUEL PUMP

BACKGROUND OF THE INVENTION

1. Field of the Invention

The invention relates to a high-pressure fuel pump.

2. Description of Related Art

A high-pressure fuel pump is known in which a plunger is slidably inserted inside of a cylinder of a pump housing such that fuel can be drawn in and discharged by a reciprocating motion of the plunger, in an internal combustion engine that performs a high-pressure fuel injection.

Japanese Patent Application Publication No. 2006-257972 (JP 2006-257972 A) describes a high-pressure fuel pump in which a fuel seal member is arranged between an outer peripheral surface portion of a plunger on a head side and an inner peripheral surface portion of a pump housing, and an escape passage (i.e., a return passage), is formed in the pump housing, such that fuel that has leaked out from the location where the plunger slides in a cylinder returns to a fuel inlet portion of the pump housing.

SUMMARY OF THE INVENTION

With a related high-pressure fuel pump such as that described above, foreign matter mixed in with fuel may get caught between an inner peripheral surface portion of the fuel seal member and the outer peripheral surface portion of the plunger on the head side by way of the escape passage from the fuel inlet portion of the pump housing, and possibly damage the fuel seal member.

The invention thus provides a high-pressure fuel pump in which foreign matter mixed in with fuel will not enter a return passage, and that therefore enables damage to the fuel seal member by foreign matter to be avoided.

A first aspect of the invention relates to a high-pressure fuel pump that includes a pump housing, a plunger, an intake valve, a discharge valve, a fuel seal member, and a fuel inlet conduit. The pump housing includes a fuel pressurizing chamber, an intake passage and a discharge passage that are communicated with the fuel pressurizing chamber, a cylinder housing, a cover member that covers the cylinder housing member, and an intake gallery chamber that is defined by the cylinder housing member and the cover member. The plunger is slidably inserted into the fuel pressurizing chamber and the cylinder housing member, and configured to pressurize fuel in the fuel pressurizing chamber. The intake valve is communicated with the intake passage and is mounted to the pump housing, and is configured such that fuel flows in from the intake gallery chamber. The discharge valve is communicated with the discharge passage and is mounted to the pump housing. The fuel seal member seals between an outer peripheral surface portion of the plunger and the pump housing. The fuel inlet conduit is connected to the cover member and configured to introduce fuel into the intake gallery chamber from outside the cover member. The pump housing includes a return passage that communicates the intake gallery chamber with a space surrounded by the plunger, the cylinder housing member, and the fuel seal member. A first end portion of the return passage on the intake gallery chamber side is positioned on an opposite side of the cylinder housing member from the fuel inlet conduit.

According to this structure, the end portion of the return passage on the intake gallery chamber side is positioned on the opposite side of the cylinder housing member from the fuel inlet conduit, so even if foreign matter is mixed in with the fuel that flows into the intake gallery chamber from the fuel inlet conduit, the foreign matter will not easily enter the return passage.

The reason for this is that foreign matter that is mixed in with the fuel that flows into the intake gallery chamber from the fuel inlet conduit is unable to reach the return passage without going around the cylinder housing member. That is, there is a distance between the fuel inlet conduit and the return passage, and the cylinder housing member is between the fuel inlet conduit and the return passage, so foreign matter will not easily enter the return passage. Therefore, foreign matter will not get caught between the inner peripheral surface portion of the fuel seal member and the outer peripheral surface portion of the plunger, so the fuel seal member will not be damaged.

A second aspect of the invention relates to a high-pressure fuel pump that includes a pump housing, a plunger, an intake valve, a discharge valve, a fuel seal member, and a fuel inlet conduit. The pump housing includes a fuel pressurizing chamber, an intake passage and a discharge passage that are communicated with the fuel pressurizing chamber, a cylinder housing member, a cover member that covers the cylinder housing member, and an intake gallery chamber that is defined by the cylinder housing member and the cover member. The plunger is slidably inserted into the fuel pressurizing chamber and the cylinder housing member, and configured to pressurize fuel in the fuel pressurizing chamber. The intake valve is communicated with the intake passage and is mounted to the pump housing, and is configured such that fuel flows in from the intake gallery chamber. The discharge valve is communicated with the discharge passage and is mounted to the pump housing. The fuel seal member seals between an outer peripheral surface portion of the plunger and the pump housing. The fuel inlet conduit is connected to the cover member and configured to introduce fuel into the intake gallery chamber from outside the cover member. The pump housing has a return passage that communicates the intake gallery chamber with a space surrounded by the plunger, the cylinder housing member, and the fuel seal member. The intake gallery chamber is such that a first end portion of the return passage on the intake gallery chamber side is positioned on an opposite side of the cylinder housing member from the fuel inlet conduit.

According to this structure, the intake gallery chamber is such that the end portion of the return passage on the intake gallery chamber side is positioned on the opposite side of the cylinder housing member from the fuel inlet conduit, so even if foreign matter is mixed in with the fuel that flows into the intake gallery chamber from the fuel inlet conduit, the foreign matter will not easily enter the return passage.

The reason for this is that foreign matter that is mixed in with the fuel that flows into the intake gallery chamber from the fuel inlet conduit is unable to reach the return passage without going around the cylinder housing member. That is, the fuel inlet conduit and the return passage are separated by a distance, and the cylinder housing member is between the fuel inlet conduit and the return passage, so foreign matter will not easily enter the return passage. Therefore, foreign matter will not get caught between the inner peripheral surface portion of the fuel seal member and the outer peripheral surface portion of the plunger, so the fuel seal member will not be damaged.

The high-pressure fuel pump may also include a return conduit that is arranged in the intake gallery chamber. The return conduit may be connected to the cylinder housing member such that a second end portion of the return conduit is communicated with the first end portion of the return passage, and a third end portion of the return conduit is positioned higher than an open end portion of the fuel inlet conduit.

According to this structure, the other end portion of the return conduit is positioned higher than the open end portion of the fuel inlet conduit, so even if foreign matter is mixed in with the fuel that flows into the intake gallery chamber from the fuel inlet conduit, the foreign matter will not get caught between the inner peripheral surface portion of the fuel seal member and the outer peripheral surface portion of the plunger, so the fuel seal member will not be damaged.

The invention is thus able to provide a high-pressure fuel pump in which foreign matter mixed in with fuel will not enter a return passage, and that therefore enables damage to the fuel seal member by foreign matter to be avoided.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Hereinafter, example embodiments of the invention will be described with reference to the accompanying drawings.

FIGS. 1 to 4 are views of a high-pressure fuel pump according to an example embodiment of the invention.

The high-pressure fuel pump of this example embodiment is provided in an internal combustion engine mounted in a vehicle. The high-pressure fuel pump pressurizes fuel supplied to the internal combustion engine to a high pressure with a plunger, and then discharges the high-pressure fuel. The internal combustion engine is a so-called in-cylinder injection type or dual injection type multiple cylinder gasoline engine (hereinafter simply referred to as "engine") that injects fuel directly into a cylinder, for example.

Figure 1:
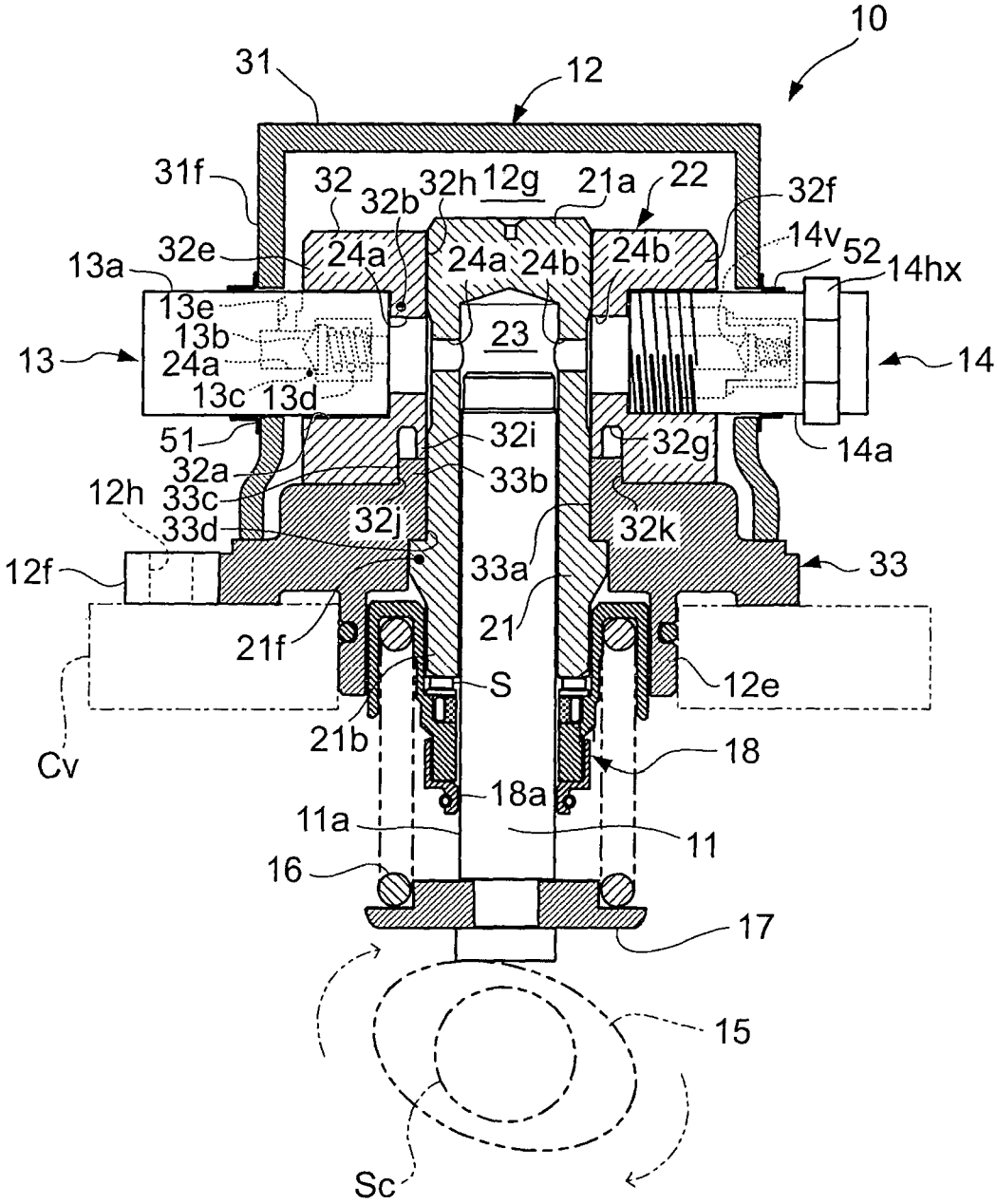
FIG. 1 is a schematic longitudinal sectional view of a high-pressure fuel pump according to one example embodiment of the invention.

The high-pressure fuel pump 10 of this example embodiment shown in FIG. 1 is connected on an inlet side thereof to a low-pressure fuel circuit to which fuel is supplied from a low-pressure fuel pump, not shown. The high-pressure fuel pump 10 takes in fuel that has been drawn up from within a fuel tank by the low-pressure fuel pump and pressurized to a feed pressure. The low-pressure fuel pump is formed by an electric pump or the like in which a pump impeller is rotatably driven by a drive motor, for example.

The high-pressure fuel pump 10 is connected on a discharge side thereof to a plurality of in-cylinder injection injectors via a delivery pipe, and pumps the high-pressure fuel to the delivery pipe. The delivery pipe stores and accumulates the high-pressure fuel discharged from the high-pressure fuel pump 10. The delivery pipe distributes and supplies the high-pressure fuel to injectors that inject fuel directly into the cylinders of the engine (hereinafter referred to as "in-cylinder injection") when the valves of these injectors open.

As shown in FIG. 1, the high-pressure fuel pump 10 includes a generally circular cylindrical plunger 11, a pump housing 12, an intake valve unit 13, and a discharge valve unit 14. The pump housing 12 retains one end side of the plunger 11 in such a manner that the plunger 11 is able to be reciprocatingly displaced in an axial direction. The intake valve unit 13 and the discharge valve unit 14 are mounted to the pump housing 12 so as to face a radial direction that is orthogonal to the axis of the plunger 11.

When engaged with a driving cam 15 on the lower side in FIG. 1, the plunger 11 is urged to the driving cam 15 side via a return spring 16 and a spring support plate 17, such that the plunger 11 moves in a reciprocating motion up and down in FIG. 1 as the driving cam 15 rotates. This driving cam 15 has a cam profile in which the lift amount becomes larger at at least one location in the circumferential direction, for example, a cam profile with an elliptical shape or a polygonal shape with rounded edges. This driving cam 15 is integrally mounted to a cam shaft Sc on an exhaust side or intake side of the engine, and is rotatably driven by the power of the engine, for example.

A mounting flange portion 12*f* and a mounting engaging portion 12*e* are provided on a base end side of the pump housing 12. A plurality of mounting bolt holes 12*h* are formed in the mounting flange portion 12*f*. The mounting engaging portion 12*e* is inserted into a mounting hole portion of a pump mounting case Cv that is integrally formed with a head cover and the like. The pump housing 12 is fastened to the pump mounting case Cv by a plurality of bolts, not shown, that are inserted into the plurality of mounting bolt holes 12*h*. A seal unit 18 having both a fuel seal and an oil seal is interposed between the plunger 11 and the pump housing 12.

The pump housing 12 is formed by a cylinder member 21 that slidably guides the plunger 11, and a housing main body (a cylinder housing member) 22 in which this cylinder member 21 is press-fit into a center portion thereof. A fuel pressurizing chamber 23 capable of pressurizing fuel via the plunger 11, an intake passage 24*a* (i.e., a fuel intake passage) that is communicated with this fuel pressurizing chamber 23, and a discharge passage 24*b* (i.e., a fuel discharge passage) are formed by the cylinder member 21 and the housing main body 22.

The intake passage 24*a* is configured to be able to take in fuel from the low-pressure fuel pump into the fuel pressurizing chamber 23. The discharge passage 24*b* is configured to be able to discharge fuel that has been pressurized in the fuel pressurizing chamber 23 to the delivery pipe side from the fuel pressurizing chamber 23.

The housing main body 22 includes a cover member 31, an upper housing member 32, and a lower housing member 33. The cover member 31 has a cup shape, i.e., is formed in the shape of an open cylinder with a bottom, through which the intake valve unit 13 and the discharge valve unit 14 pass in the left-right direction in FIG. 1. The upper housing member 32 is housed inside of the cover member 31. The lower housing member 33 has the mounting flange portion 12*f* and a spring support portion of the return spring 16, and together with the cylinder member 21, closes off the open end of the cover member 31.

When the cylinder member 21 is in a state press-fit, in a direction perpendicular to the axis, into a center portion of the housing main body 22 in a longitudinal direction thereof, the cover member 31, the upper housing member 32, and the lower housing member 33 are integrally connected together. Any suitable connecting method such as press-fitting, brazing, or thread connecting may be employed as the method for connecting the cover member 31 to the lower housing member 33, and the method for connecting the cylinder member 21 to the lower housing member 33.

An intake gallery chamber 12*g* is formed inside the pump housing 12, around the upper housing member 32. This intake gallery chamber 12*g* is a chamber of a predetermined volume that is communicated with the intake passage 24*a*. Low-pressure side fuel is stored in this intake gallery chamber 12*g*, and a well-known pulsation damper, not shown, is housed in the intake gallery chamber 12*g*.

Although not shown in detail, the intake valve unit 13 includes a cylindrical-shaped outer cylinder member 13*a*, an intake valve body 13*b*, and a valve spring 13*d*. In the outer cylinder member 13*a*, a valve seat 13*c* is formed midway in the intake passage 24*a*. The intake valve body 13*b* and the valve spring 13*d* are housed inside the outer cylinder member 13*a*. The outer cylinder member 13*a* is inserted into, or thread connected to, an intake-side mounting hole 32*a* of the upper housing member 32, and abuts against an abutting portion 32*b* on the far inside of this intake-side mounting hole 32*a*. An inflow hole 13*e* that is communicated with the intake passage 24*a* from the outside is formed in the outer cylinder member 13*a*.

The intake valve body 13*b* is constantly urged to the valve-closed side, for example, by the valve spring 13*d*, and is placed in a valve-open position when a predetermined valve opening differential pressure, in which the fuel pressurizing chamber 23 side becomes a low pressure, shall exist in front and behind the intake valve body 13*b*. Also, the intake valve unit 13 may have a solenoid or the like capable of placing the intake valve body 13*b* in the valve-open position, or may place the intake valve body 13*b* that is normally open in a valve-closed position with a solenoid or the like.

Figure 2:
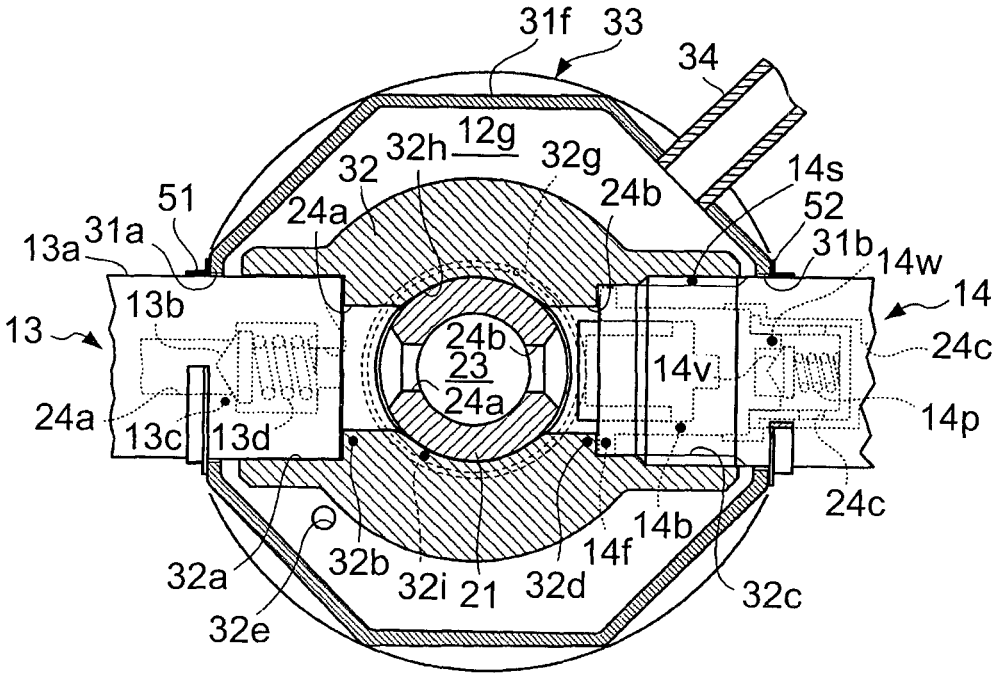
FIG. 2 is a schematic horizontal sectional view of the high-pressure fuel pump according to the example embodiment, when viewed at a central axis position of a fuel passage thereof.

Referring to FIGS. 1 and 2, the discharge valve unit 14 has an outer cylinder member 14*a* and an inner cylinder member 14*b*. The outer cylinder member 14*a* is thread connected to a discharge-side mounting hole 32*c* of the upper housing member 32. The inner cylinder member 14*b* is press-fit inside the outer cylinder member 14*a* from a screw tip end of the outer cylinder member 14*a*. A portion of the discharge passage 24*b* is formed by the outer cylinder member 14*a* and the inner cylinder member 14*b*. A discharge valve body 14*v* having a check valve function is housed inside the outer cylinder member 14*a*. The discharge valve unit 14 is a fluid control unit that is screwed to the housing main body 22 such that the discharge passage 24*b* opens and closes by the discharge valve body 14*v*.

The outer cylinder member 14*a* of the discharge valve unit 14 has a threaded portion 14*s* that screws to the housing main body 22. The outer cylinder member 14*a* abuts against an abutting portion 32*d* via a flange portion 14*f* of the inner cylinder member 14*b* at a tip end side of the threaded portion 14*s*. The abutting portion 32*d* is positioned on the far inside of the mounting hole 32*c* of the upper housing member 32.

A valve seat 14*w* that forms a portion of the discharge passage 24*b* and is opened and closed by the discharge valve body 14*v* engaging and disengaging with it (i.e., the valve seat 14*w*) is formed on the inner cylinder member 14*b*. A valve spring 14*p* that constantly urges the discharge valve body 14*v* in the valve-closing direction is housed in the inner cylinder member 14*b*. A portion of the inner cylinder member 14*b* that is on the downstream side of the valve seat 14*w*, together with the outer cylinder member 14*a*, defines a portion of a high-pressure passage portion 24*c* that is on the downstream side of the discharge valve body 14*v*.

The discharge valve body 14*v* is placed in a valve-open position when the pressure of fuel discharged from the fuel pressurizing chamber 23 is increased beyond the downstream-side fuel pressure by a predetermined discharge valve opening differential pressure (for example, a differential pressure of several tens of kPa). That is, when the plunger 11 is displaced upward in FIG. 1 to reduce the volume of the fuel pressurizing chamber 23, the fuel inside the fuel pressurizing chamber 23 is pressurized, and the discharge valve body 14*v* is able to be displaced in the valve-opening direction when the intake valve is closed, by a differential pressure equal to or greater than the discharge valve opening differential pressure in front and behind the discharge valve body 14*v* that is consequently created.

In this way, the high-pressure fuel pump 10 in this example embodiment is provided with the pump housing 12 that has the cylinder member 21, and in which the fuel pressurizing chamber 23, the intake passage 24*a*, and the discharge passage 24*b* are formed. In this high-pressure fuel pump 10, the intake valve unit 13 and the discharge valve unit 14 are connected to the upper housing member 32 that forms the housing main body 22.

The intake valve unit 13 and the discharge valve unit 14 are inserted inside a pair of through-holes 31*a* and 31*b*, respectively, of the cover member 31 so as to pass through the cover member 31 while being arranged linearly on the same axis. The cover member 31 and the intake valve unit 13 are fixed together by welding via an annular auxiliary member 51 having a generally L-shaped cross-section, so as to hermetically seal the annular gap between them. Similarly, the cover member 31 and the discharge valve unit 14 are fixed together by welding via an annular auxiliary member 52 having a generally L-shaped cross-section, so as to hermetically seal the annular gap between them.

The cover member 31 has, on an outer peripheral side, at least one pair of parallel surfaces, e.g., four pairs of parallel surfaces 31*f*, that are parallel and separated from each other, while being orthogonal to a common axis of the intake valve unit 13 and the discharge valve unit 14. The through-holes 31*a* and 31*b* of the cover member 31 are open in one pair of parallel surfaces 31*f* that are parallel to both ends of the upper housing member 32 in a common axial direction of the intake valve unit 13 and the discharge valve unit 14, and the annular auxiliary members 51 and 52 corresponding to both of these parallel surfaces 31*f* of the cover member 31 are fixed thereto.

The upper housing member 32 has a first connecting portion 32*e* on one end side to which the intake valve unit 13 is press-fit, and a second connecting portion 32*f* on the other side to which the discharge valve unit 14 is screwed (i.e., thread connected).

The upper housing member 32 has a center press-fitting hole 32*h* into which one end portion 21*a* of the cylinder member 21 is inserted, and a lower end-side inner peripheral wall portion 32*i* that forms a lower end side (a camshaft side) of this press-fitting hole 32*h*, in a longitudinally center portion positioned between the first and second connecting portions 32*e* and 32*f*.

A gap 32*g* having a predetermined groove shape that separates the lower end-side inner peripheral wall portion 32*i* from the first and second connecting portions 32*e* and 32*f* in the radial direction of the press-fitting hole 32*h*, is formed between the lower end-side inner peripheral wall portion 32*i* and the first and second connecting portions 32*e* and 32*f*.

As shown by the broken lines in FIG. 2, this gap 32*g* is formed as a downward-facing recessed portion that surrounds the entire periphery of the lower end-side inner peripheral wall portion 32*i* of the upper housing member 32, e.g., as an annular groove. The gap 32*g* is not limited to this, however. The gap 32*g* may also be formed as a pair of arc groove shaped gaps that face the cylinder member 21, with the cylinder member 21 sandwiched in between. The sectional shape of the gap 32*g* may be rectangular, U-shaped, V-shaped, or any other suitable sectional shape, and does not have to be constant around the entire circumference.

Figure 3:
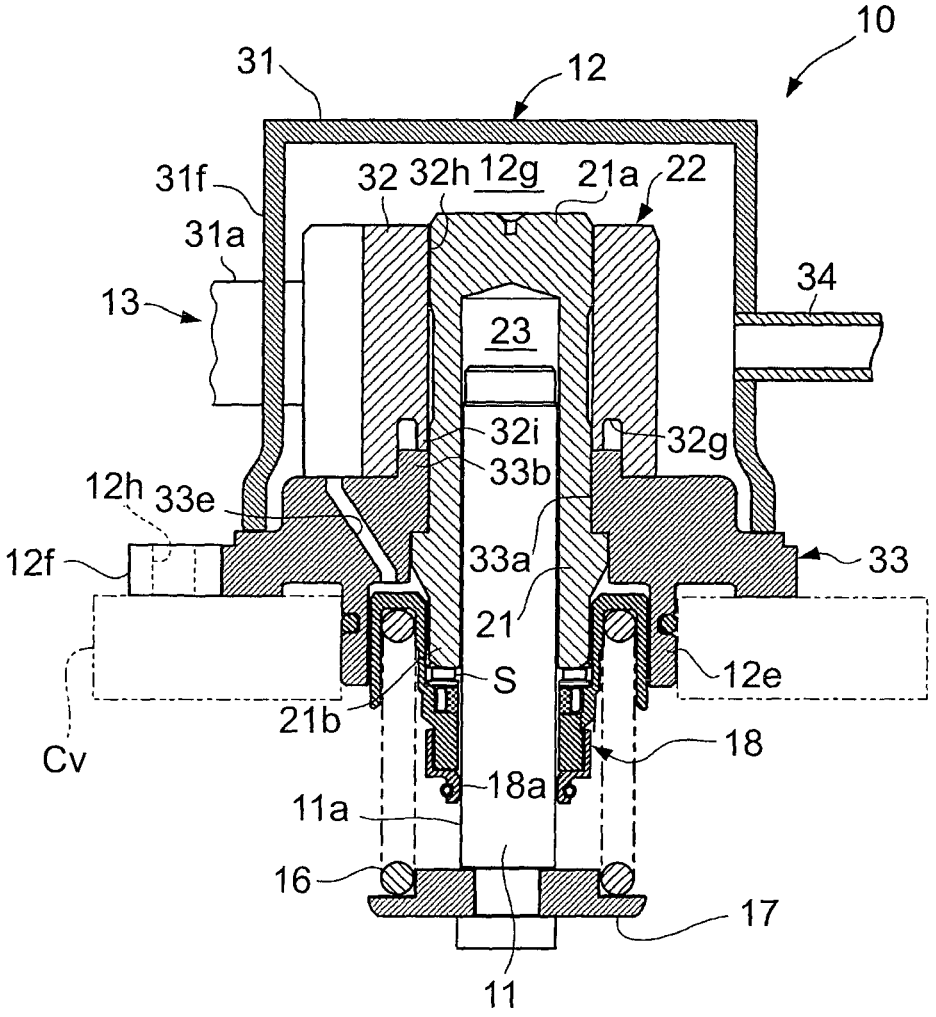
FIG. 3 is a schematic longitudinal sectional view of the high-pressure fuel pump according to the example embodiment, when viewed at a central axis position of a fuel inlet conduit thereof.

When referring to FIG. 3, the lower housing member 33 has a center insertion hole 33*a* into which the cylinder member 21 is inserted, and an annular contacting portion 33*b* having an annular protruding shape that fits into a lower portion of the upper housing member 32, around the insertion hole 33*a*.

The insertion hole 33*a* of the lower housing member 33 has substantially the same hole diameter as the press-fitting hole 32*h* of the upper housing member 32, and the press-fitting allowance with respect to the cylinder member 21 is smaller than it is with the press-fitting hole 32*h* of the upper housing member 32, for example.

The annular contacting portion 33*b* of the lower housing member 33 is arranged on the lower side in FIG. 1, which is the other end portion 21*b* side of the cylinder member 21 with respect to the upper housing member 32. The annular contacting portion 33*b* contacts the connecting portions 32*e* and 32*f* of the upper housing member 32 from the inside in the radial direction, and opposes the lower end-side inner peripheral wall portion 32*i* of the upper housing member 32 in the axial direction of the press-fitting hole 32*h*.

On an outer peripheral surface 33*c* side of the annular contacting portion 33*b* (i.e., the radially outer side of the press-fitting hole 32*h*), the annular contacting portion 33*b* contacts inner wall surface portions 32*j* and 32*k* on a lower end side of the connecting portions 32*e* and 32*f*. Meanwhile, on an inner peripheral surface 33*d* side of the annular contacting portion 33*b* (i.e., the radially inner side of the press-fitting hole 32*h*), the annular contacting portion 33*b* contacts the cylinder member 21.

The lower housing member 33 is formed in a stepped shape on the upper side in FIG. 1, and abuts against the upper housing member 32 at an upper surface and radially outer side of the annular contacting portion 33*b*, and abuts against an increased diameter portion 21*f* of the cylinder member 21 on the lower side in FIG. 1. The lower housing member 33 has the mounting flange portion 12*f* on the outer peripheral side.

The intake valve unit 13 and the discharge valve unit 14 may be screwed to the upper housing member 32, or integrally connected thereto by another connecting method, or they may be integrally formed as a single part. An engaging portion for engaging a tool when screw tightening, e.g., a hexagonally-shaped tool engaging portion 14*hx* having an increased diameter, and a screw portion for a pipe connection, not shown, or the like, are provided on an outer periphery on one end side of the outer cylinder member 14*a* of the discharge valve unit 14.

The seal unit 18 described above is externally fitted to the plunger 11 such that an outer peripheral surface portion 11*a* of the plunger 11 contacts an inner peripheral surface portion 18*a*. The seal unit 18 serves to seal between the plunger 11 and the cylinder member 21 that forms the pump housing 12.

The cover member 31 described above covers the cylinder member 21, the upper housing member 32, and the lower housing member 33. The entire periphery of the open end of the cover member 31 is hermetically fixed to an upper surface of an outer edge portion of the lower housing member 33, and the cover member 31 forms the intake gallery chamber 12*g* that is surrounded by the cylinder member 21, the cover member 31, the upper housing member 32, and the lower housing member 33. This intake gallery chamber 12*g* is communicated with the intake passage 24*a* of the upper housing member 32 via the inflow hole 13*e* formed in the outer cylinder member 13*a* of the intake valve unit 13.

Figure 4:
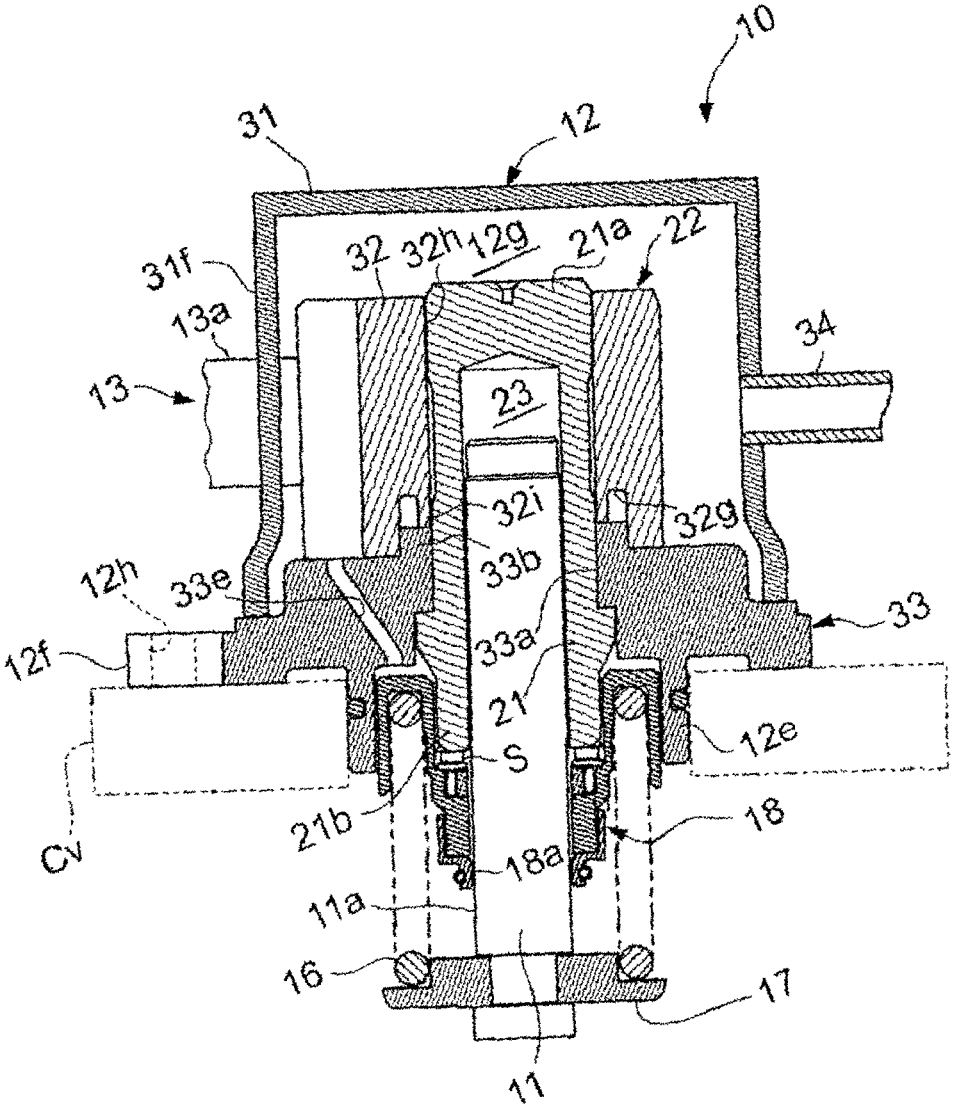
FIG. 4 is a schematic longitudinal sectional view of an example of an assembly posture of the high-pressure fuel pump according to the example embodiment.

The high-pressure fuel pump 10 of this example embodiment includes a fuel inlet conduit 34, as shown in FIGS. 2 to 4. The fuel inlet conduit 34 is connected to the cover member 31 such that one end portion of the fuel inlet conduit 34 is communicated with a fuel discharge port of a low-pressure fuel pump, not shown, and the other end portion of the fuel inlet conduit 34 is communicated with the intake gallery chamber 12*g*.

In the high-pressure fuel pump 10, a return passage 33*e* is formed in the lower housing member 33, as shown in FIGS. 2 to 4. The return passage 33*e* communicates a space S surrounded by the outer peripheral surface portion 11*a* of the plunger 11, the cylinder member 21, and the seal unit 18, with the intake gallery chamber 12*g*. An end portion of the return passage 33*e* that is on the intake gallery chamber 12*g* side (i.e., a first end portion of the return passage 33*e*) is positioned on the opposite side of the cylinder member 21 from the fuel inlet conduit 34.

Next, the operation of the high-pressure fuel pump 10 of this example embodiment will be described.

In the high-pressure fuel pump 10, fuel discharged from the low-pressure fuel pump is introduced into the intake gallery chamber 12*g* by the fuel inlet conduit 34. The high-pressure fuel pump 10 feeds the fuel introduced into the intake gallery chamber 12*g* to the fuel pressurizing chamber 23 inside the cylinder member 21 via the inflow hole 13*e* formed in the outer cylinder member 13*a* of the intake valve unit 13, and the intake passage 24*a* of the first connecting portion 32*e* of the upper housing member 32.

The high-pressure fuel pump 10 compresses the fuel fed to the fuel pressurizing chamber 23 by the displacement of the plunger 11, and feeds the compressed fuel to an injector, not shown, via the discharge passage 24*b* of the second connecting portion 32*f* of the upper housing member 32, and the high-pressure passage portion 24*c* defined by the outer cylinder member 14*a* and the inner cylinder member 14*b* of the discharge valve unit 14.

The high-pressure fuel pump 10 circulates fuel that has flowed down from the fuel pressurizing chamber 23 into the space S surrounded by the outer peripheral surface portion 11*a* of the plunger 11, the cylinder member 21, and the seal unit 18, to the intake gallery chamber 12*g* via the return passage 33*e*.

In the high-pressure fuel pump 10 of this example embodiment structured as described above, the end portion of the return passage 33*e* on the intake gallery chamber 12*g* side is positioned on the opposite side of the cylinder member 21 from the fuel inlet conduit 34, so even if foreign matter is mixed in with the fuel that flows into the intake gallery chamber 12*g* from the fuel inlet conduit 34, the foreign matter will not easily enter the return passage 33*e*.

The reason for this is that foreign matter that is mixed in with the fuel that flows into the intake gallery chamber 12*g* from the fuel inlet conduit 34 is unable to reach the end portion of the return passage 33*e* on the intake gallery chamber 12*g* side without going around the cylinder member 21. That is, the fuel inlet conduit 34 and the end portion of the return passage 33*e* on the intake gallery chamber 12*g* side are separated by a distance, and the cylinder member 21 is between the fuel inlet conduit 34 and the end portion of the return passage 33*e* that is on the intake gallery chamber 12*g* side, so foreign matter will not easily enter the return passage 33*e*.

Therefore, in this example embodiment, foreign matter will not easily get caught between the inner peripheral surface portion 18*a* of the seal unit 18 and the outer peripheral surface portion 11*a* of the plunger 11, so damage to the seal unit 18 is able to be inhibited. As a result, the high-pressure fuel pump 10 in which foreign matter mixed in with the fuel will not enter the return passage 33*e*, and that therefore enables damage to the seal unit 18 by foreign matter to be avoided, is able to be provided.

FIG. 4 is a view of an example of an assembly posture of the high-pressure fuel pump 10 in a vehicle. The high-pressure fuel pump 10 is assembled to the vehicle such that a predetermined angle is formed between the axis of the plunger 11 and a vertical line. The end portion of the return passage 33*e* on the intake gallery chamber 12*g* side is positioned vertically higher than the open end portion of the fuel inlet conduit 34.

In the high-pressure fuel pump 10 assembled to the vehicle as described above, the end portion of the return passage 33*e* on the intake gallery chamber 12*g* side is positioned higher than the open end portion of the fuel inlet conduit 34, so foreign matter is able to be inhibited from entering the return passage 33*e*.

The reason for this is that foreign matter that is mixed in with the fuel that flows into the intake gallery chamber 12*g* from the fuel inlet conduit 34 sinks to a portion of the intake gallery chamber 12*g* on the fuel inlet conduit 34 side and thus will not easily reach the end portion of the return passage 33*e* on the intake gallery chamber 12*g* side. Therefore, foreign matter that is mixed in with the fuel will not enter the return passage 33*e*, so damage to the seal unit 18 by foreign matter can be avoided.

Figure 5:
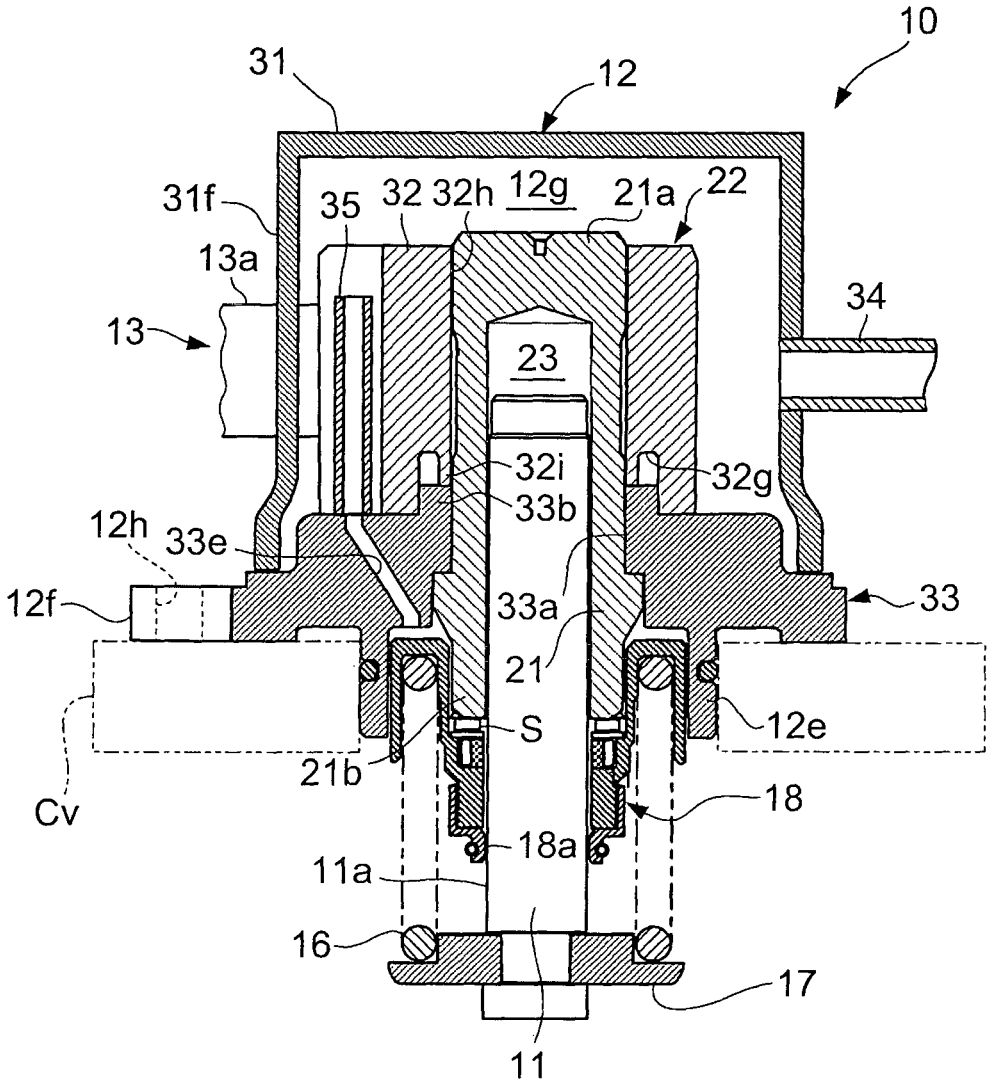
FIG. 5 is a schematic longitudinal sectional view of a high-pressure fuel pump according to a modified example of the example embodiment of the invention, when viewed at a central axis position of a fuel inlet conduit thereof.

Next, a modified example of the high-pressure fuel pump according to the example embodiment of the invention will be described with reference to FIG. 5.

The modified example of the example embodiment described below is a high-pressure fuel pump 10 having substantially the same overall structure as that of the example embodiment described above, but differs from the structure in the example embodiment described above in that a return conduit 35 is provided. Therefore, in the modified example of the example embodiment described below, component parts that are substantially similar to those in the foregoing example embodiment will be denoted by the same reference characters as those that denote corresponding component parts shown in FIGS. 1 to 3, and only the differences from the foregoing example embodiment will be described.

The return conduit 35 is arranged in the intake gallery chamber 12*g*. The return conduit 35 is connected to the lower housing member 33 such that one end portion (a second end portion) of the return conduit 35 is communicated with an end portion (a first end portion) of the return passage 33*e* on the intake gallery chamber 12*g* side, and the other end portion (a third end portion) of the return conduit 35 is positioned higher than the open end portion of the fuel inlet conduit 34.

In the high-pressure fuel pump 10 of the modified example of the example embodiment structured as described above, the other end portion (the third end portion) of the return conduit 35 is positioned higher than the open end portion of the fuel inlet conduit 34, so foreign matter is able to be inhibited from entering the return passage 33*e*.

The reason for this is that foreign matter that is mixed in with the fuel that flows into the intake gallery chamber 12*g* from the fuel inlet conduit 34 sinks to a portion of the intake gallery chamber 12*g* that is on the fuel inlet conduit 34 side, and thus will not easily reach the end portion of the return passage 33*e* on the intake gallery chamber 12*g* side.

Accordingly, with the modified example of the example embodiment, foreign matter will not easily get caught between the inner peripheral surface portion 18*a* of the seal unit 18 and the outer peripheral surface portion 11*a* of the plunger 11, so damage to the seal unit 18 is able to be inhibited. As a result, the high-pressure fuel pump 10 in which foreign matter mixed in with fuel will not enter the return passage 33*e*, and that therefore enables damage to the seal unit 18 by foreign matter to be avoided, is able to be provided.

Furthermore, the high-pressure fuel pump of the invention is not limited to a pump in which gasoline is used as the fuel. That is, the high-pressure fuel pump of the invention may also be effectively applied to an engine that uses another kind of fuel.

As described above, with the high-pressure fuel pump according to the example embodiment of the invention and the modified example thereof, foreign matter that is mixed in with the fuel will not enter the return passage, so damage to the seal unit by foreign matter is able to be avoided. This kind of invention is useful as a general high-pressure fuel pump that has a fuel seal member that seals between an outer peripheral surface portion of a plunger and a pump housing.

The invention claimed is:

1. A high-pressure fuel pump comprising:

a pump housing including
- a fuel pressurizing chamber,
- an intake passage communicated with the fuel pressurizing chamber,
- a discharge passage communicated with the fuel pressurizing chamber,
- a cylinder housing member,
- a cover member covering the cylinder housing member, and
- an intake gallery chamber defined by the cylinder housing member and the cover member;

a plunger slidably inserted into the fuel pressurizing chamber and the cylinder housing member, and the plunger being configured to pressurize fuel in the fuel pressurizing chamber;

an intake valve communicated with the intake passage and mounted to the pump housing, and the intake valve being configured such that fuel flows in from the intake gallery chamber;

a discharge valve communicated with the discharge passage and mounted to the pump housing;

a fuel seal member sealing between an outer peripheral surface portion of the plunger and the pump housing; and a fuel inlet conduit connected to the cover member and configured to introduce fuel into the intake gallery chamber from outside the cover member, wherein the pump housing includes a single continuous return passage that communicates the intake gallery chamber with a space surrounded by the plunger, the cylinder housing member, and the fuel seal member, the cylinder housing member includes an upper housing member and a lower housing member, the upper housing member is housed inside of the cover member, and the intake gallery chamber is disposed around the upper housing member, the lower housing member closes off an open end of the cover member, and a first end portion of the return passage on the intake gallery chamber side is open to the intake gallery chamber and is positioned on an opposite side of the upper housing member from the fuel inlet conduit such that, when viewed in a plan view, an imaginary straight line passes through the fuel inlet conduit, the first end portion, and the fuel pressurizing chamber.

2. A high-pressure fuel pump comprising:

a pump housing including a fuel pressurizing chamber, an intake passage communicated with the fuel pressurizing chamber, a discharge passage communicated with the fuel pressurizing chamber, a cylinder housing member, a cover member covering the cylinder housing member, and an intake gallery chamber defined by the cylinder housing member and the cover member;

a plunger slidably inserted into the fuel pressurizing chamber and the cylinder housing member, and the plunger being configured to pressurize fuel in the fuel pressurizing chamber;

an intake valve communicated with the intake passage and mounted to the pump housing, and the intake valve being configured such that fuel flows in from the intake gallery chamber;

a discharge valve communicated with the discharge passage and mounted to the pump housing;

a fuel seal member sealing between an outer peripheral surface portion of the plunger and the pump housing; and a fuel inlet conduit connected to the cover member and configured to introduce fuel into the intake gallery chamber from outside the cover member, wherein the pump housing includes a single continuous return passage that communicates the intake gallery chamber with a space surrounded by the plunger, the cylinder housing member, and the fuel seal member, the cylinder housing member includes an upper housing member and a lower housing member, the upper housing member is housed inside of the cover member, and the intake gallery chamber is disposed around the upper housing member, the lower housing member closes off an open end of the cover member, and the intake gallery chamber is such that a first end portion of the return passage is open to the intake gallery chamber and is positioned on an opposite side of the cylinder housing member from the fuel inlet conduit.

3. The high-pressure fuel pump according to claim 1, further comprising:

a return conduit arranged in the intake gallery chamber, and connected to the cylinder housing member such that a second end portion of the return conduit is communicated with the first end portion of the return passage, and a third end portion of the return conduit is positioned higher than an open end portion of the fuel inlet conduit.

4. The high-pressure fuel pump according to claim 2, further comprising:

a return conduit arranged in the intake gallery chamber, and connected to the cylinder housing member such that a second end portion of the return conduit is communicated with the first end portion of the return passage, and a third end portion of the return conduit is positioned higher than an open end portion of the fuel inlet conduit.

5. The high-pressure fuel pump according to claim 1, wherein the return passage is formed through the lower housing member.

6. The high-pressure fuel pump according to claim 2, wherein the return passage is formed through the lower housing member.

7. The high-pressure fuel pump according to claim 1, wherein a distance of the first end portion along a radial line from a center axis of the plunger is greater than a distance of an outer surface of the upper housing along the radial line.

* * * * *